United States Patent [19]

Snellman et al.

[11] Patent Number: 4,625,955

[45] Date of Patent: Dec. 2, 1986

[54] SHEET FEEDER

[75] Inventors: Donald L. Snellman, 2807 W. Galer St., Seattle, Wash. 98199; Bernard A. Pearson; John W. Jacobs, both of King County, Wash.

[73] Assignee: Donald L. Snellman, Seattle, Wash.

[21] Appl. No.: 692,055

[22] Filed: Jan. 16, 1985

[51] Int. Cl.[4] ..... B65H 3/06

[52] U.S. Cl. ..... 271/10; 271/9; 271/117; 271/111; 271/114; 271/274

[58] Field of Search ..... 271/4, 9, 10, 21, 22, 271/110, 111, 114, 116, 117, 122, 259, 262, 263, 274, 258

[56] References Cited

U.S. PATENT DOCUMENTS

| | | | |
|---|---|---|---|
| 3,525,517 | 8/1970 | Toby | 271/117 |
| 3,825,248 | 7/1974 | Friend | 271/10 |
| 3,942,789 | 3/1976 | Townsend | 271/274 |
| 3,961,786 | 6/1976 | Yanker | 271/122 |
| 3,964,739 | 6/1976 | Garcia | 271/274 |
| 3,981,493 | 9/1976 | Klappenecker et al. | 271/259 |
| 3,988,017 | 10/1976 | Kyhl | 271/259 |
| 4,039,181 | 8/1977 | Prewer | 271/10 |
| 4,121,716 | 10/1978 | Luperti et al. | 271/263 |
| 4,176,834 | 12/1979 | Takahashi | 271/117 |
| 4,386,769 | 6/1983 | Ito et al. | 271/9 |
| 4,523,754 | 6/1985 | Hisajima et al. | 271/264 |
| 4,527,793 | 7/1985 | Böttcher et al. | 271/263 |

OTHER PUBLICATIONS

Edwards, E. G., *IBM Technical Disclosure Bulletin*, vol. 23, No. 6, Nov. 1980, pp. 2228–2229.

*Primary Examiner*—Bruce H. Stoner, Jr.
*Assistant Examiner*—James E. Barlow
*Attorney, Agent, or Firm*—Seed and Berry

[57] ABSTRACT

A sheet feeder with a feed wheel assembly for conveying an end sheet from a stack of sheets. The feed wheel assembly has a rotatable engagement wheel positioned to contact the end sheet of the stack, and operable to separate and convey the end sheet from the stack; a horizontally extending first shaft on which the wheel is mounted, with the first shaft being angularly movable in a generally vertical direction; a horizontally extending second shaft positioned spaced apart from the first shaft, the second shaft being mounted in a substantially fixed planar orientation to a support frame; and a pair of laterally spaced-apart first and second arms extending between the first and second shafts. Each of the first and second arms has a first portion retaining the first shaft and a second portion longitudinally spaced from the first portion and pivotally connected to the second shaft. The first and second arms are independently-pivotally movable about the second shaft within at least a limited range to permit uninhibited angular movement of the first shaft in a generally vertical direction during operation.

32 Claims, 15 Drawing Figures

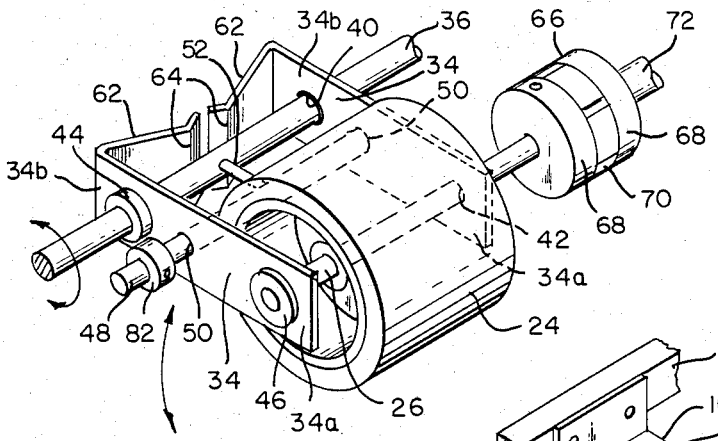
FIG. 5
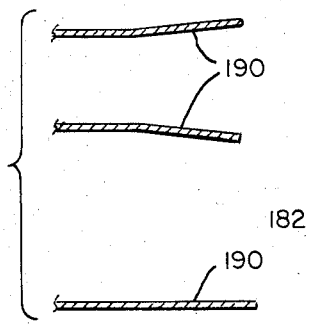
FIG. 9
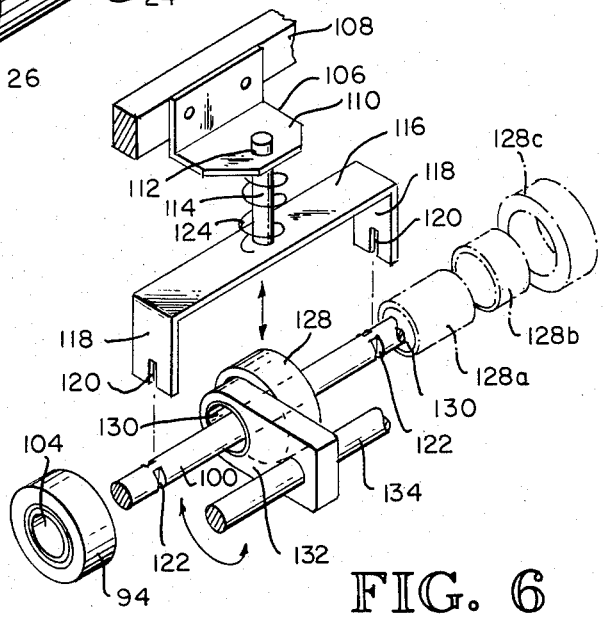
FIG. 6
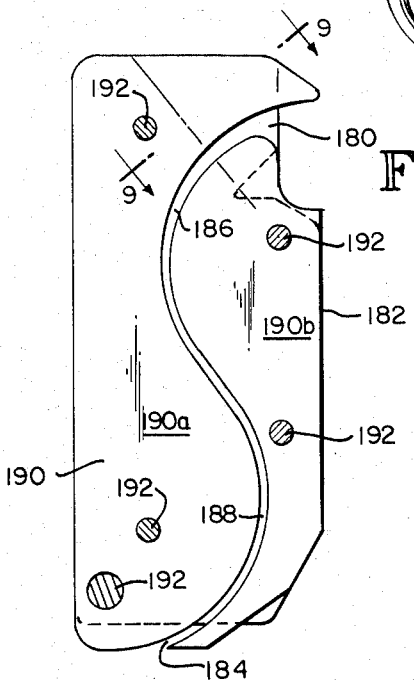
FIG. 7
FIG. 8
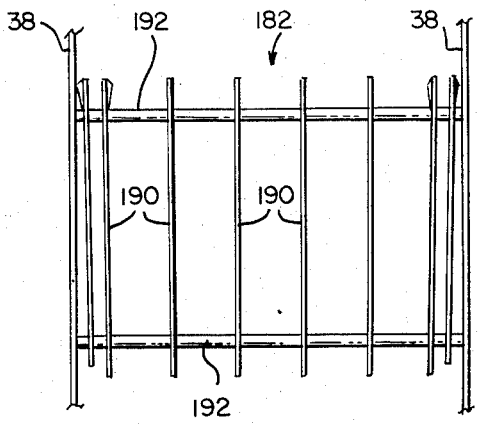

FIG. 10
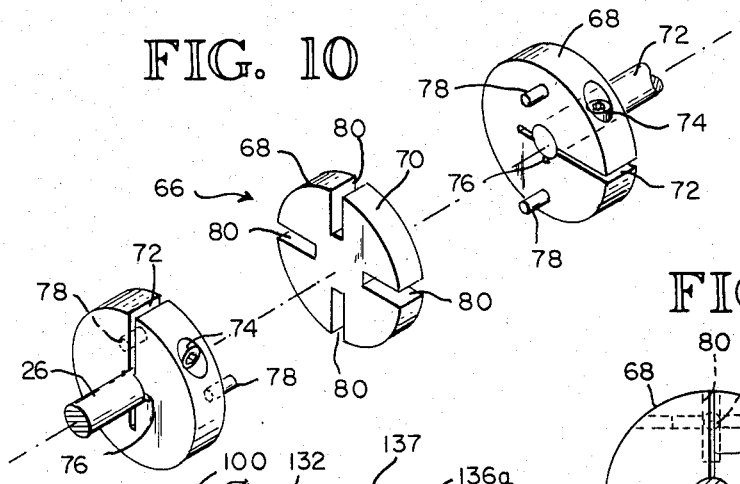
FIG. 11
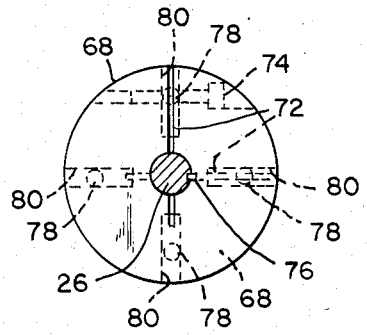
FIG. 14
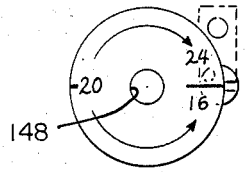
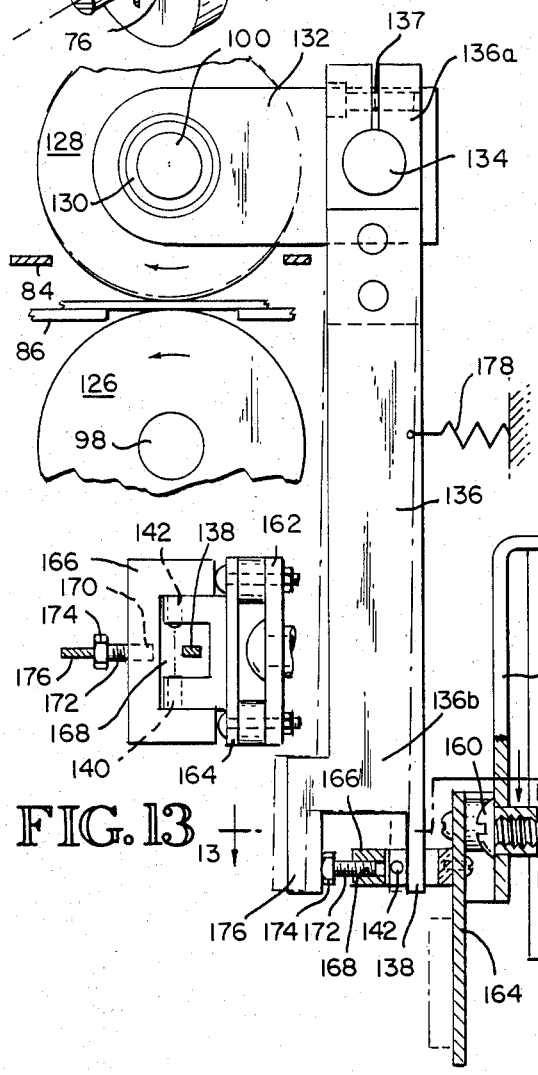
FIG. 13
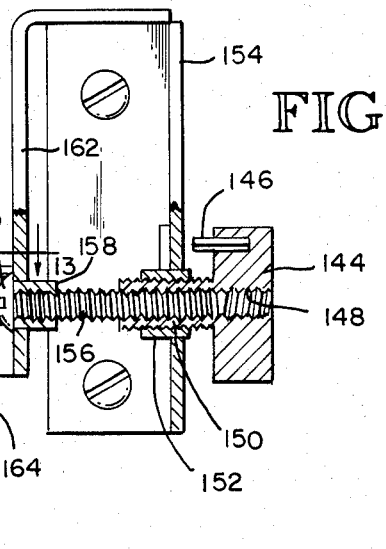
FIG. 12

SHEET FEEDER

TECHNICAL FIELD

The present invention relates generally to sheet feeders, and more particularly, to a high-speed, dual-tray sheet feeder for selectively conveying single sheets from the top of two stacks of sheets upon command from an apparatus with which the sheet feeder is used.

BACKGROUND ART

Conventional sheet feeders which feed sheets from the top of a stack frequently skew the sheet being fed, requiring the use of a separate sheet jogging or straightening device to straighten the sheet before it is fed to the apparatus with which the sheet feeder is being used. The use of a sheet jogging or other conventional sheet straightening devices adds extra expense and requires the sheet to travel a sufficient distance along the feed path so that it can be straightened, thus resulting in a sheet feeder having a longer feed path and a greater size than otherwise necessary. This is particularly a problem when the sheets are fed at high speeds using a driven feed wheel. Such a feed wheel often does not make even contact with the top sheet to be conveyed along the entire longitudinal length of the feed wheel, and a skewed feed results.

Other problems are encountered when attempting to feed sheets selectively from two stacks positioned on spaced-apart trays. One problem is in inserting one or more sheets from one stack between sheets from the other stack upon command from the apparatus with which the sheet feeder is used in a manner which provides a rapid, smooth and continuous flow of sheets from both stacks onto a single feed path. Another problem is in feeding the sheets to the apparatus with which the sheet feeder is used within a short period after a sheet request signal is given. This is necessary so that the operating speed of the apparatus is not unduly slowed by the sheet feeder and so that the apparatus does not register an error because a sheet has taken too long to reach the apparatus after the sheet request signal has been given.

Another problem often encountered with sheet feeders involves the feed wheel feeding more than one sheet at a time from a stack. In the past, such an error condition has been successfully indicated through use of a doubles detector such as described in U.S. patent application Ser. No. 480,121, filed on Mar. 25, 1983, now abanoned. Such a doubles detector, however, must be accurately calibrated by passage of single and double sheets between a pair of rollers to preset the roller spacing. The spacing is set such that a single sheet will freely pass between the rollers, but double sheets will cause the rollers to move apart and trigger a sensor. In the past, the calibration has been done by hand, and achieving an accurate setting has been time-consuming and subject to operator error.

It will therefore be appreciated that there has been a significant need for a sheet feeder designed to overcome these problems. The present invention fulfills this need and further provides other related advantages.

DISCLOSURE OF INVENTION

The present invention resides in a sheet feeder having an improved feed wheel assembly. The feed wheel assembly is mounted to a support frame for conveying the upper sheet from a stack of sheets, and includes an engagement wheel positionable above the stack for contact with the upper sheet of the stack and operable to separate and convey the upper sheet from the stack. The engagement wheel is mounted for rotation with a generally horizontally extending, rotatable first shaft; and drive means are connected to the first shaft for selective rotation of the wheel while permitting substantially unrestricted vertical and angular movement of the first shaft during operation within at least a limited range. The feed wheel assembly further includes a generally horizontally extending second shaft positioned spaced apart from and generally parallel with the first shaft. The second shaft is mountable in a substantially fixed position relative to the support frame and is at least partially rotatable. The rotation of the second shaft is detectable to drive a stack raising mechanism as sheets are removed from the stack of sheets.

A pair of laterally spaced-apart first and second arms extend between the first and second shafts, with the engagement wheel positioned therebetween. Each of the first and second arms has a first portion rotatably supporting the first shaft axially outward of the wheel opposite the first portion of the other of the arms, and has a second portion longitudinally spaced from the first portion and pivotally connected to the second shaft. The first and second arms are pivotally movable independent of each other about the second shaft within at least a limited range under the weight of the wheel.

A third shaft is positioned intermediate the wheel and the second shaft, and extends between the first and second arms at a midportion thereof positioned between the first and second arm portions. The third shaft is loosely received with a retaining aperture in each of the first and second arms. A pin extends between the second shaft and the third shaft, and is fixedly attached to the second shaft for rotation therewith and is pivotally attached to the third shaft. As such, the wheel can move substantially unimpeded to seek contact with the upper sheet of the stack of sheets along the full axial length thereof, while being free to move downward as upper sheets of the stack are successively conveyed away and to move upward as the stack is raised during periodic repositioning thereof to compensate for decreasing stack height. The rotation of the second shaft in response to the wheel moving downward to contact the upper sheets of the stack as the stack height decreases can be sensed to actuate a mechanism to periodically raise the stack.

The drive means connected to the first shaft includes a universal coupler drivingly connecting the first shaft to a rotatable drive shaft while permitting substantially unrestricted vertical movement of the first shaft relative to the drive shaft during operation. The drive means is connected to the first shaft outward of the first arm. The feed wheel assembly further includes an adjustable balance weight connected to apply a counterbalance force to the second arm to maintain balance of the assembly generally along the longitudinal center line during operation. The pin extends between the second shaft and the third shaft generally along the longitudinal center line between the first and second arms, with elevational movement of the engagement wheel being transmitted through the pin to the second shaft substantially without effect on the angular axial orientation of the wheel. An end portion of the pin is loosely received within a radial bore in the third shaft.

The first and second shafts are positioned generally coplanar in a horizontal plane. The second portions of the first and second arms each have an aperture therein loosely receiving the second shaft. The first and second arms each have an inwardly projecting portion fixedly attached to the second arm portion and positioned to a side of the second shaft away from the wheel. The inwardly projecting portion slidably engages the second shaft to limit outward lateral movement of the arms.

The sheet feeder further includes a receiving tray for holding a stack of sheets, and the engagement wheel is positioned above the receiving tray for contact with the upper sheet of the stack thereon and is incrementally driven. The sheet feeder further includes means for raising the receiving tray responsive to rotation of the second shaft resulting from downward movement of the engagement wheel as upper sheets of the stack are successively conveyed away. The stack can thereby be raised to compensate for decreasing stack height.

The sheet feeder also has a second receiving tray for holding a second stack of sheets positioned above the first receiving tray, and a second incrementally driven engagement wheel positioned above the second receiving tray for contact with the upper sheet of the stack thereon.

The sheet feeder has first feed means for receiving the upper sheets conveyed by the first engagement wheel and feeding the upper sheet along a feed path to the apparatus to which the sheet feeder is connected. A second feed means is provided for receiving the upper sheet conveyed by the second engagement wheel and feeding the upper sheet to a curved deflector with an input for receiving the upper sheet of the second stack from the second feed means. The curved deflector has an output for depositing the upper sheet of the second stack along the feed path for feeding to the apparatus to which the feeder is connected. As such, the apparatus is fed sheets from a single feed path supplied by two trays.

The first and second feed means feeds sheets in the same direction of travel, and the deflector has a reverse-curve, arcuate-shaped deflector path to guide sheets from the level of the second feeder means to the level of the lower first feeder means for travel of the sheets from both feed means along the feed path in the same direction. The deflector has an upper curved section for guiding the sheets from the second feed means through at least a ninety-degree downwardly directed turn, and a lower curved section for guiding the sheets received from the upper curved section through at least a ninety-degree outwardly directed turn. The deflector provides a continuous, gradually turning deflector path with a large radii. The upper and lower curved sections are connected together by an intermediate section, and the upper curved section has an enlarged deflector path. The deflector is comprised of a plurality of substantially parallel deflector plate assemblies oriented generally transverse to the conveyed sheets. Each of the deflector plate assemblies includes a pair of plates with spaced-apart edge portions shaped to form the deflector path for passage of the sheets therebetween.

The sheet feeder further includes first sensor means for detecting receipt of the upper sheet by the feed means and deactivating the engagement wheel, and second sensor means for detecting passage of the upper sheet into a ready position and deactivating the feed means. The ready position is located for rapid delivery of the upper sheet therefrom by the feed means. Also provided is means responsive to a sheet request signal from the apparatus to which the sheet feeder is connected for activating the feed means to convey the upper the sheet to the apparatus. A third sensor is provided for detecting passage of the upper sheet from the ready position and actuating the engagement wheel to convey the next upper sheet from the stack.

The sheet feeder has separating means for receiving the upper sheet conveyed by the engagement wheel and ensuring isolation of a single sheet. The separating means includes a pair of opposed, spaced-apart upper and lower rollers between which the upper sheet of the stack is received from the engagement wheel. The upper and lower rollers rotate in the same rotational direction to urge the upper sheet toward the feed means and the other sheets traveling therewith back toward the engagement wheel.

The sheet feeder has two pairs of opposed upper and lower rollers between which the upper sheet of the stack is received from the engagement wheel. One roller of each pair is biased toward the other and at least the upper or lower roller of each pair is rotatably driven. The two pair of rollers are axially spaced apart.

In one embodiment, the upper rollers are rotatably mounted on a roller shaft, and the roller shaft is substantially unrestrained against angular movement in a generally vertical direction. The feed means includes biasing means for application of a balanced downward biasing force on the upper rollers, and the biasing means applies a substantially equal downward force to the roller shaft at two spaced-apart positions substantially symmetrical with respect to the upper rollers. The biasing means includes a member positioned above the upper roller shaft and having a pair of downwardly extending arms engaging the upper roller shaft for application of the downward biasing force thereto. The arms are axially spaced apart along the upper roller shaft. The member is vertically and pivotally movable in a generally vertical plane, and is biased toward the upper roller shaft by a resilient biasing element. Means are provided for the upper rollers to freely rotate in a rotational direction corresponding to the direction of travel of the sheets conveyed by the driven lower rollers, but to restrain the upper rollers against rotation in the opposite rotational direction.

The sheet feeder further includes means for detecting more than one sheet being conveyed by the engagement wheel between the upper and lower feed rollers. The detecting means has an upper detector roller positioned generally coaxial with the upper feed roller and has an enlarged axial opening for uninhibited passage of the upper shaft therethrough. A lower detector roller is mounted on the lower shaft. A link rotatably supports the upper detector roller in a position a preselected distance above the lower detector roller and connects the upper detector roller to a detector shaft for translating vertical movement of the upper detector roller responsive to passage of more than one sheet between the upper and lower detector rollers into rotational movement of the detector shaft.

An elongated arm is fixedly attached by one end portion to the detector shaft and has a vane at its opposite end for interrupting a beam of light projecting between a light source and a photodetector. Passage of more than one sheet between the upper and lower detector rollers produces rotation of the detector shaft to move the vane into or out of the beam of light, and thereby generate an indicator signal. The detector means further includes first adjustment means for adjusting the position of the upper detector roller above the lower detector roller to adjust the distance therebetween according to the thickness of sheets being fed. The detector means also includes a second adjustment means for adjusting the position of the vane relative to the beam of light to a desired distance therefrom for establishing a threshold sensing position.

The first adjustment means includes a hand-operated knob rotatable between at least two rotational positions, each corresponding to a thickness of the sheets being fed. The first adjustment means also includes actuation means responsive to rotation of the knob between the at least two rotational positions to adjustably fix the distance of the upper detector roller above the lower detector roller to cause the indicator signal to be generated only when more than one sheet of the thickness of the sheet being fed passes between the upper and lower detector rollers. The knob has an interiorly threaded portion and an exteriorly threaded portion. The exteriorly threaded portion of the knob being threadably received by a correspondingly threaded fixed member. The actuation means includes a threaded shaft threadably received by the interior threaded portion of the knob and having threads corresponding thereto. The interiorly and exteriorly threaded portions of the knob have the same hand-threads with different lead angles to produce differential movement between the shaft and the knob and to move the shaft axially upon rotation of the knob. The shaft engages the elongated arm for movement of the arm. Any such movement of the arm is transmitted through the link to adjust the position of the upper detector roller above the lower detector roller. The actuation means further includes a resilient member biasing the threaded shaft axially toward the knob. The light source and photodetector are connected to the shaft in fixed relative relation for movement therewith. The detector means further includes a second threaded shaft engaging the elongated arm for adjusting the position of the vane relative to the beam of light projecting between the light source and the photodetector by rotation of the second threaded shaft.

Other features and advantages of the invention will become apparent from the following detailed description, taken in conjunction with the accompanying drawings.

BRIEF DESCRIPTION OF THE DRAWINGS

FIG. 5 is an enlarged, fragmentary, isometric view of the sheet engaging feed wheel of the sheet feeder of FIG. 1.

FIG. 6 is an enlarged, fragmentary, isometric view of the upper feed roller and doubles detector roller assembly, showing the detector roller exploded in phantom line.

FIG. 7 is an enlarged side elevational view of the curved feed path guide plate assembly for the upper tray of the sheet feeder of FIG. 1.

FIG. 8 is an enlarged, fragmentary, top plan view of the guide plate assembly of FIG. 7.

FIG. 9 is a fragmentary view taken substantially along the line 9—9 of FIG. 7 showing several of the guide plates comprising the guide plate assembly.

FIG. 10 is an enlarged, fragmentary, exploded isometric view of the universal joint for the sheet feed wheel shown in FIG. 5.

FIG. 11 is an enlarged, sectional side elevational view of the universal joint of FIG. 10.

FIG. 12 is an enlarged, fragmentary, sectional side elevational view of the doubles detector mechanism of the sheet feeder of FIG. 1, showing the doubles detector roller of FIG. 6.

FIG. 13 is a sectional view taken substantially along the line 13—13 of FIG. 12.

FIG. 14 is a side elevational view of the adjustment knob of the doubles detector mechanism shown in FIG. 12.

BEST MODE FOR CARRYING OUT THE INVENTION

Figure 1:
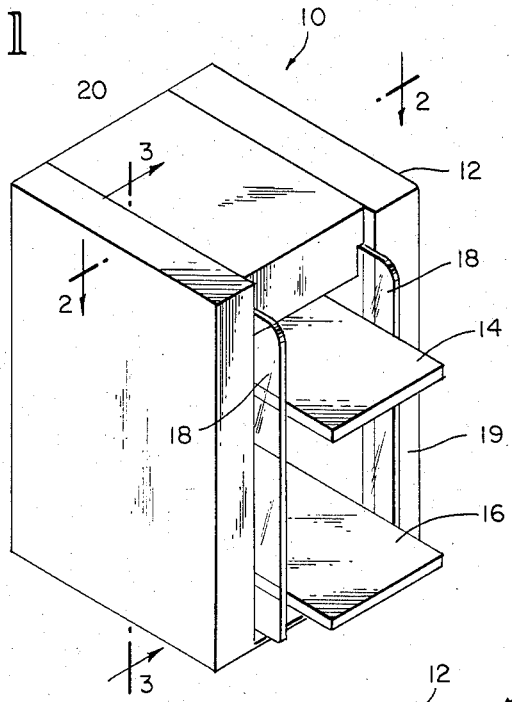
FIG. 1 is an isometric view of a dual tray sheet feeder embodying the present invention.

As shown in the drawings for purposes of illustration, the present invention is embodied in a sheet feeder, indicated generally by reference numeral 10. The sheet feeder 10 is generally enclosed within an exterior case 12 and has an upper tray 14 and a lower tray 16 positioned thereunder for receiving and holding upper and lower stacks of sheets, shown as 17*u* and 171*l*, respectively, in FIG. 15. The upper and lower trays 14 and 16 extend outward of an open front loading side 19 of the case 12 through which the stacks of sheets are loaded onto the trays. A pair of guide panels 18 located to each side of the trays 14 and 16 assist in maintaining the vertical stacking of the sheets. An open delivery side 20 of the case 12 is adapted for placement adjacent to an apparatus 22 to which the sheet feeder 10 of the present invention is to deliver sheets. The apparatus 22 is shown in phantom in FIGS. 3, 4 and 15 as a pair of rotating receiving rollers.

Sheet feeding mechanisms which in large part are functionally and structurally identical, except to the extent hereinafter described, remove sheets from the upper and lower trays 14 and 16 of the sheet feeder 10 and deliver the sheets upon command to the apparatus 22. To avoid repetition, the feeding mechanism will be described only with respect to the upper tray 14 and the components of both feeding mechanisms will be provided identical reference numerals. It should be understood that the same description is generally applicable to the feeding mechanism for the lower tray 16.

Figure 2:
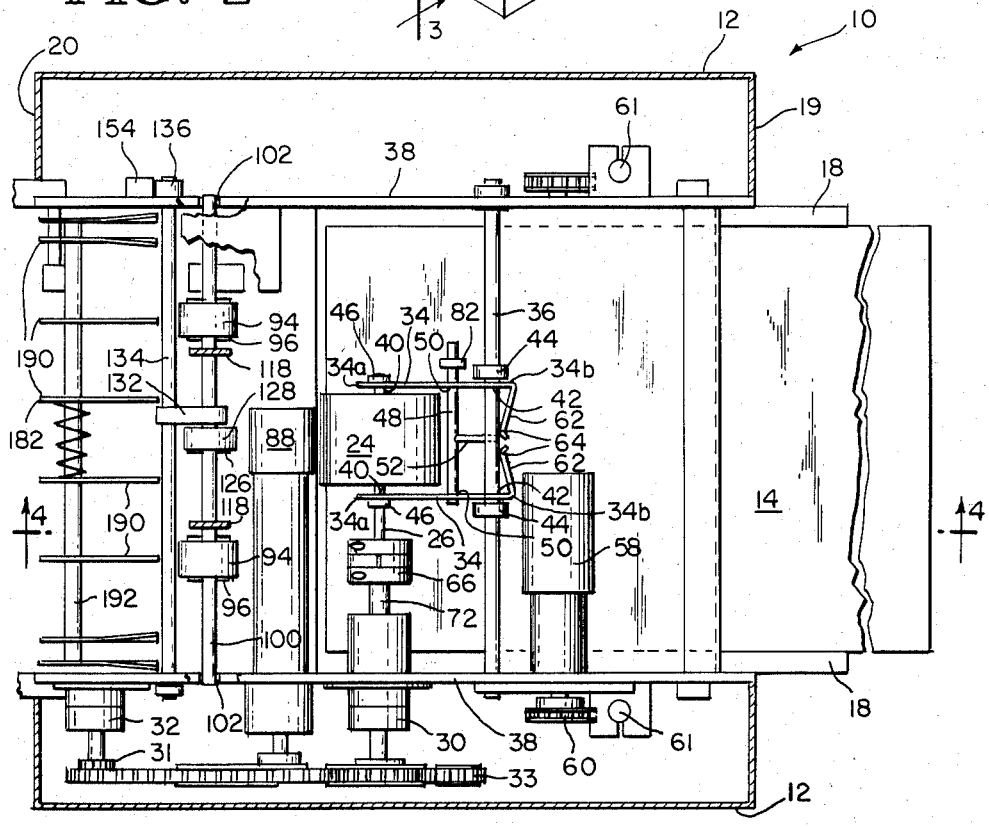
FIG. 2 is an enlarged sectional view taken substantially along the line 2—2 of FIG. 1, showing a top plan view of the upper tray sheet feeding mechanism.
Figure 4:
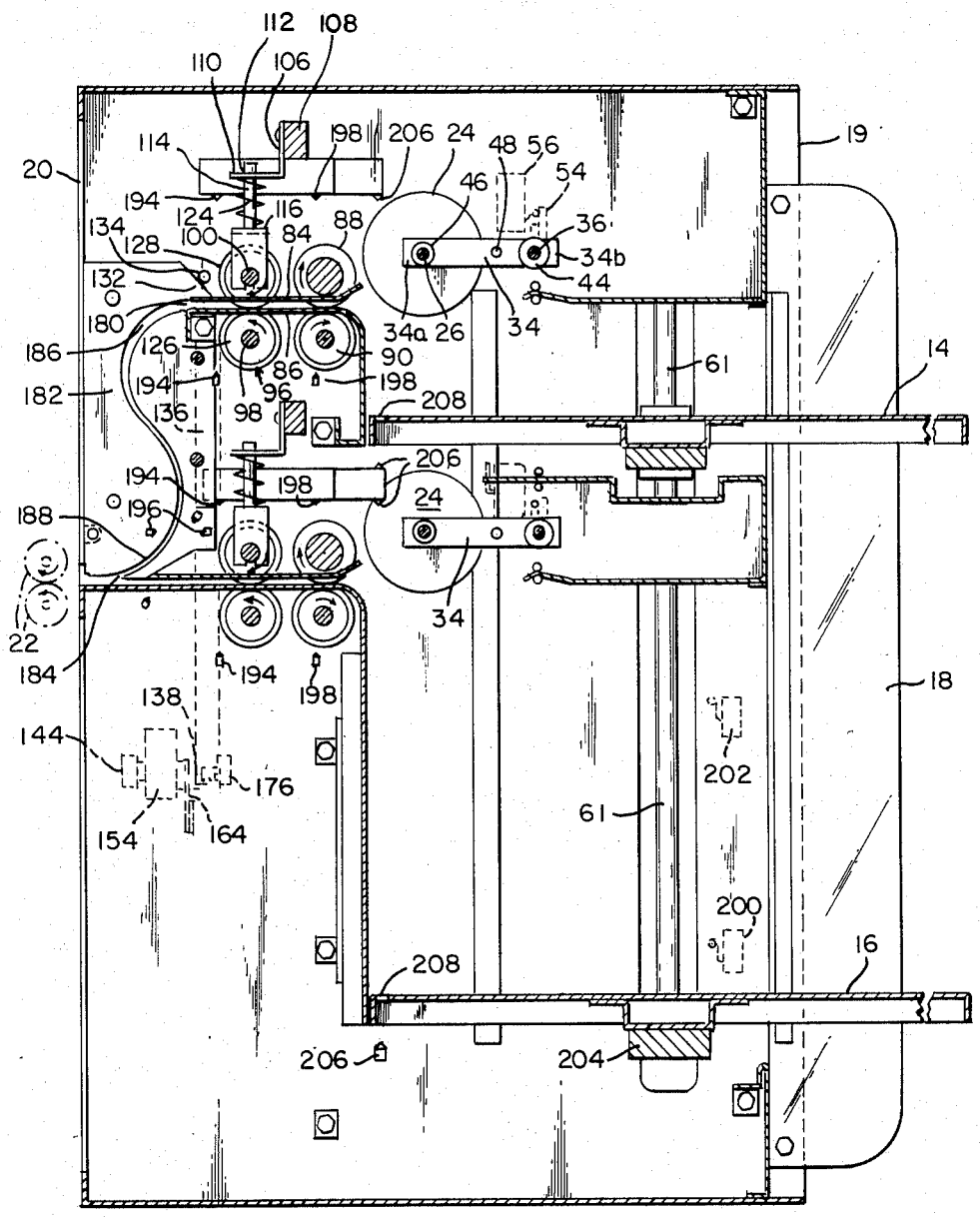
FIG. 4 is a sectional view taken substantially along the line 4—4 of FIG. 2, showing a side elevational view of the sheet feeding mechanisms of the upper and lower trays.

Referring to FIGS. 2, 4 and 5, the feeding mechanism includes an engagement wheel 24 positioned above the upper tray 14 for frictional engagement with an upper sheet of the upper stack 17*u* to separate the sheet from the stack and convey the sheet along an upper feed path extending toward the delivery side 20 of the sheet feeder 10. The engagement wheel 24 contacts the inward end portion of the upward face of the upper sheet. To improve the engagement, the engagement wheel 24 is covered with silicon. For increased speed of operation, a vacuum wheel may be used.

The engagement wheel 24 is fixedly mounted on a generally horizontally oriented, laterally extending shaft 26 for rotation therewith. Rotational drive is selectively applied to the shaft 26 by a motor 28 through an electrically controlled clutch 32 (see FIG. 3). As will be described in more detail below, the engagement wheel 24 is incrementally driven in response to internally generated electrical signals responsive to movement of the sheets and sheet request signals from the apparatus 22 to which sheet feeder 10 is connected.

Figure 3:
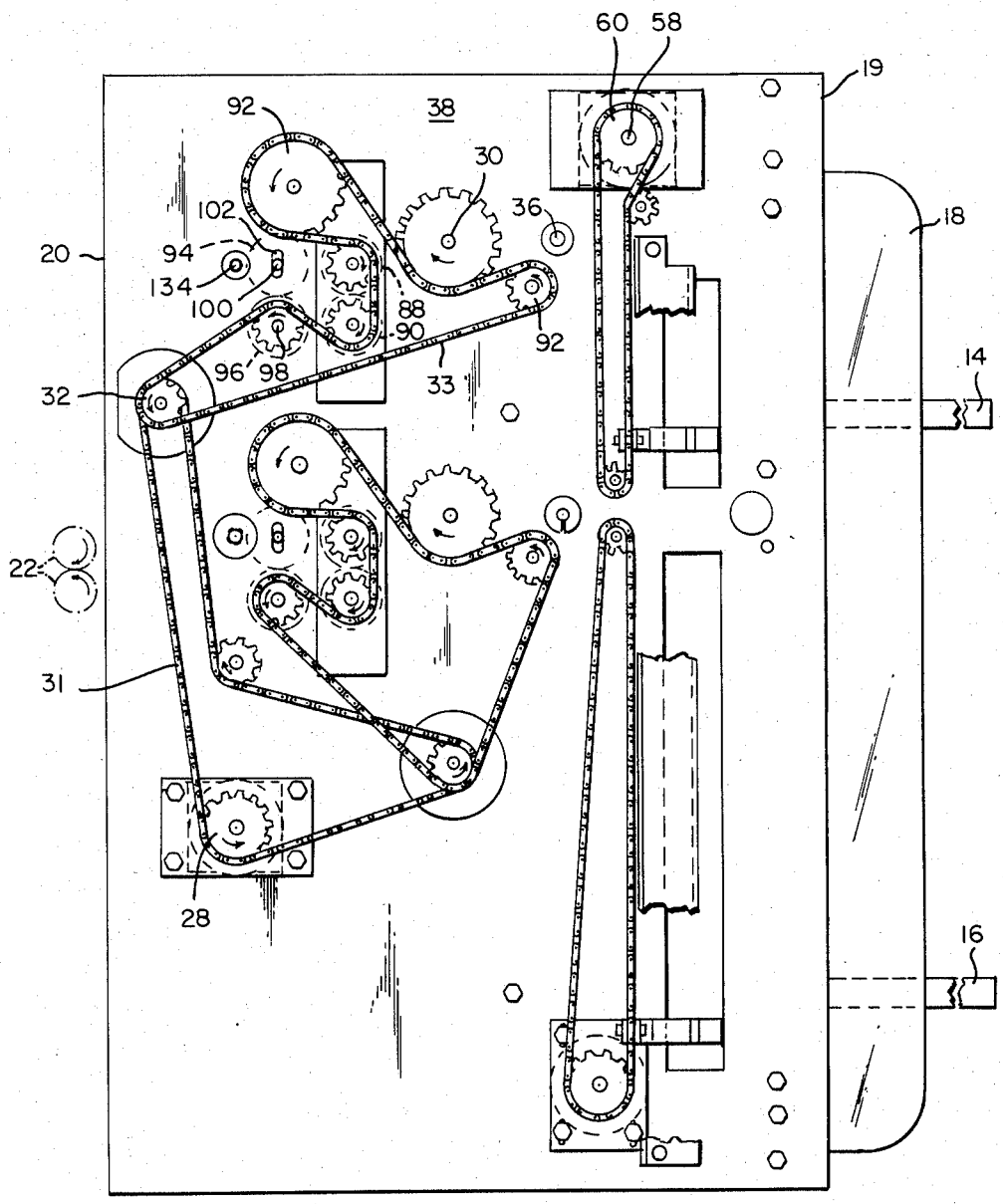
FIG. 3 is an enlarged sectional view taken substantially along the line 3—3 of FIG. 1, showing the drive belt arrangement for the sheet feeder.

As best shown in FIG. 3, the motor 28 provides the primary drive for the sheet feeding mechanisms of the sheet feeder 10, and drives a main drive chain 31. A clutch 32 selectively provides drive from the main drive chain 31 to the upper tray feed mechanism through an upper drive chain 33. The upper drive chain 33 selectively drives the engagement wheel 24 through the clutch 30. In normal operation, the clutch 32 provides continuous drive to the upper drive chain 33, while the clutch 30 incrementally drives the engagement wheel 24 as needed to feed sheets.

The shaft 26 is rotatably supported by a pair of laterally spaced apart arms 34 with the engagement wheel 24 positioned therebetween. A first end portion 34*a* of each of the arms 34 towrd the delivery side 20 supports the shaft 26 and an opposite, second end portion 346 of each arm toward the loading side 19 is pivotally connected to a generally horizontally oriented, laterally extending shaft 36. The shafts 26 and 36 are generally positioned in co-planar relation. The shat 36 is rotatably supported at both ends by a pair of upright side plates 38 forming the interior support frame for the sheet feeder 10, and the shaft 36 is at least partially rotatable. Each of the arms 34 has at its second end portion 346 an aperture 40 sized to loosely receive the shaft 36, and at its first end portion 34*a* an aperture 42 sized to loosely receive the shaft 26. This permits the independent pivotal movement of each of the arms 34 about the shaft 36, and the substantially uninhibited angular movement of the shaft 26, and hence the engagement wheel 24 mounted thereon, in a generally vertical direction during operation of the sheet feeder 10. Laterally outward movement of the arms 34 on the shaft 36 and on the shaft 26 toward the side plates 38 is prohibited by a pair of stops 44 fixedly attached to the shaft 36 and a pair of stops 46 fixedly attached to the shaft 26.

Another shaft 48 is positioned intermediate of the engagement wheel 24 and the shaft 36, and extends between a midportion of the arms 34. The intermediate shaft 48 is loosely received within a retaining aperture 50 in each of the arms 34. A pin 52 extends between the shaft 48 and the shaft 36 along the longitudinal center line between the arms 34, and has its one end loosely received in a radial bore in the shaft 48 for pivotal movement relative thereto and its other end fixedly attached to the shaft 36.

Since the arms 34 are pivotally movable about the shaft 36 independent of each other within at least a limited range under the weight of the engagement wheel 24 and angular movement of the engagement wheel is provided relative to the arms, the engagement wheel can move substantially unimpeded under its own weight to seek contact with the upper sheet of the stack 17*u* along the full axial length of the wheel to provide an even and straight drive to the sheet. The engagement wheel 24 is also free to move generally downward as upper sheets of the stack 17*u* are successively conveyed away and to move generally upward as the stack is raised during periodic repositioning to compensate for decreased stack height. This prevents the skewed feeding of sheets which can occur if only one edge portion of the engagement wheel 24 engages the sheet to provide an uneven drive to the sheet. Such skewed feeding conventionally results from the difficulty or impossibility of manufacturing and assembling a drive wheel in perfect parallel alignment with the upper sheet of the stack, and from the fact that the orientation of the stack changes as the stack height changes during operation and changes from one stack of sheets to the next. With the present invention, the engagement wheel 24 compensates for the stack orientation and the sheets are fed in a sufficiently straight manner along the feed path without the need for jogging or other sheet straightening devices to align the sheets being fed. This provides a more compact sheet feeder 10 with greater speed and less misalignment of the sheets fed.

Experience has shown that only minute position adjustments of a few thousandth of an inch are generally required for the engagement wheel 24 to assure that the wheel applies an even drive to the sheet along the full axial length of the wheel, but the angular orientation of the wheel must automatically and quickly change in response to the continuous and unpredictable changes in the angular orientation of the upper sheet of the stack 17*u* that occur during operation of the sheet feeder 10.

With the present invention, torsional movement of the engagement wheel 24 about the longitudinal center line between the arms 34 will not cause rotation of the shaft 36. This is because of the enlarged aperatures 50 in the arms 34 receiving the shaft 48 and the pivotal attachment of the pin 52 to the shaft 48 which allows the arms to move freely and within a limited range sufficient for normal operation independently without rotation of the shaft 36. Elevational movement of the engagement wheel 24 will, however, be transmitted by the arms 34 through the shaft 48 and the pin 52 to the shaft 36, causing its rotation in a direction corresponding to the movement of the engagement wheel without effect on the angular axial orientation of the wheel. Rotation of the shaft 36 in the counterclockwise direction (as viewed in FIG. 4) as a result of the engagement wheel 24 moving downward as upper sheets of the stack 17*u* are successively conveyed away, causes a member 54 fixedly attached to the shaft 36 for rotation therewith to contact and activate a microswitch 56.

The microswitch 56 turns on a motor 58 (see FIG. 3) which drives the upper tray 14 through a drive chain 60 and causes the upper tray to move upward laterally guided on a pair of vertical guide bars 61. The engagement wheel 24 rides on the stack 17*u* and by its own weight moves with the upper tray 14, and when the engagement wheel has been moved upward sufficiently to break the contact of the member 54 with the microswitch 56, the microswitch is deactivated and the motor 58 is turned off. This stops the upward movement of the upper tray, at least until a sufficient number of upper sheets of the stack 17*u* are successively conveyed away to once again lower the stack enough to cause the activation of microswitch 56 and energizing of the motor 58. In the presently preferred embodiment of the invention, the engagement wheel 24 moves downward sufficiently to reposition the upper tray 14 upward after about three to five sheets have been conveyed away from the stack 17*u*.

The arms 34 each have a laterally inward projecting portion 62 fixedly attached to the second end portion 34*b* portion of the arm and positioned to a side of the shaft 36 away from the engagement wheel 24. The projecting portions 62 each have a bearing surface 64 which slidably contacts the shaft 36 to limit laterally outward movement of the arms 34 without inhibiting the free rotation of the arms on the shaft 36. In such fashion, the engagement wheel assembly is held in general alignment with the feed path of the upper tray 14. In the presently preferred embodiment of the invention, the inwardly projecting portions 62 of the arms 34 are formed as an integral part of the arms.

Rotary drive is provided to the shaft 26 by the clutch 30 through a universal joint 66. The universal joint 66 provides transmission of the rotary drive while permitting substantially unrestricted vertical and angular movement of the shaft 26, and hence the engagement wheel 24, as the elevation and angular orientation of the engagement wheel changes during operation of the sheet feeder 10.

The universal joint 66 is shown in detail in FIGS. 10 and 11, and includes a pair of outer discs 68 with an inner disc 70 positioned therebetween. The one outer disc 68 is rigidly attached to an output drive shaft 72 of the clutch 30 for rotation therewith, and the other outer disc is fixedly attached to the shaft 26. The outer discs 68 each have an outwardly opening radial slot 72 to facilitate mounting of the disc on its respective shaft 26 or 72, and a screw 74 to clamp the disc in place on the shaft. The outer discs 68 also each have a keyway 76 which cooperates with an axially oriented key (not shown) carried by the shaft to which the disc is attached.

Each other disc 68 has a pair of diametrically positioned, projecting studs 78 fixedly attached to an inward face thereof. The inner disc 70 has four outwardly opening slots 80 extending from a midportion of the disc radially outward and oriented at a 90° spacing around the disc. The slots 80 are sized to each receive one of the studs 78 of the outer discs 68. The studs 78 of one outer disc 68 are positioned in one diametrically oriented pair of slots 80 and the studs of the other outer disc are positioned in the other pair of diametrically oriented slots. The slots 80 have sufficient length to allow the studs 78 retained therein to move a substantial distance along the length of the slots and provide a universal coupling of the drive shaft 72 to the shaft 26, thus isolating the engagement wheel 24 from the drive shaft. It is to be understood that the present invention may be practiced using other suitable forms of universal or flexible coupling of the drive shaft 72 to the shaft 26 or directly to the engagement wheel 26.

To provide compensation for any unbalancing force that the universal joint 66 may apply to the shaft 26, the intermediate shaft 50 extends beyond the arm 34 to a side opposite from the universal joint and has a weight 82 adjustably attached thereto. The adjustable balance weight 82 applies a counterbalance force to the arms 34 to maintain balance of the engagement wheel assembly generally along the longitudinal center line of the assembly during operation.

In operation, the engagement wheel 20 feeds the upper sheet of the stack 17*u* forwardly with respect to travel along the upper feed path to between a pair of spaced-apart upper and lower guide plates 84 and 86, respectively, and in between a pair of upper and lower separator rollers 88 and 90, respectively. The upper separator roller 88 projects downwardly through an opening in the upper guide plate 84 and the lower separator roller 90 projects upwardly through an opening in the lower guide plate 86.

The upper and lower separator rollers 88 and 90 are rotatably driven by the upper drive chain 33 in the same rotational direction such that the upper separator roller urges the upper sheet forwardly along the upper feed path and the lower separator roller imparts a backward thrust to any sheets which may be traveling with the upper sheet to push them backward toward the engagement wheel 24 and prevent more than a single sheet from being driven forwardly by the engagement wheel. The distance between the upper and lower separator rollers 88 and 90 is adjusted to allow only a single sheet to pass through the separator rollers. As viewed in FIG. 4, the engagement wheel 24, and the upper and lower separator rollers 88 and 90 rotate in the clockwise direction.

While the engagement wheel 24 is incrementally driven through the clutch 30, the separator rollers 88 and 90 are provided constant drive by the drive chain 33 during normal operation. As shown in FIG. 4, a pair of idler sprockets 92 are used to carry the drive chain 33 to achieve a desired chain path.

The sheet is driven forwardly along the upper feed path beyond the separator rollers 88 and 90 by the engagement wheel 24, and while still between the guide plates 84 and 86, the sheet is received between two pairs of opposed upper and lower feed rollers 94 and 96, respectively. The upper feed rollers 94 are laterally spaced apart and symmetrically positioned relative to the sheets being conveyed, and project downwardly through an opening in the upper guide plate 84. The lower feed rollers 96 are positioned below and opposite the upper feed rollers 96 and extend upwardly through an opening in the lower guide plate 86. The lower feed rollers 96 are fixedly attached to a shaft 98 which is oriented transverse to the upper feed path, and extends through and is rotatably supported by the side plates 38 which form the interior support frame for the sheet feeder 10.

The shaft 98 is rotatably driven by the upper drive chain 33, and the lower feed rollers 96 rotate in the counterclockwise direction (as viewed in FIG. 4) to drive the sheet forward along the upper feed path. The upper feed rollers 94 are not driven and are carried on a non-rotatable shaft 100 having vertically oriented opposing flats on each of its end portions which extend through vertically elongated slots 102 in the side plates 38. The slots 102 are sized to prevent rotation of the shaft 100 and retain the shaft against forward or rearward movement, while allowing free angular movement of the shaft in the vertical direction.

The upper feed rollers 94 each include a ratchet mechanism 104 which permits the free clockwise rotation of the rollers (as viewed in FIG. 4) as sheets pass thereby, but prevents counterclockwise rotation of the rollers. The shaft 100 carrying the upper feed rollers 94, and hence the feed rollers themselves, are biased downwardly toward the lower feed rollers 96 to apply the pressure needed for the lower feed rollers to drivingly engage the sheet being conveyed. To provide an even and straight drive to the sheet, and avoid skewing of the sheet by driving the lower feed rollers 96, the downward biasing force on the upper feed rollers 94 is applied using a single point downward loading on the shaft 100. The loading is accomplished while permitting substantially unrestrained angular movement of the shaft 100, and hence the upper feed rollers 94, in a generally vertical direction.

As best shown in FIGS. 4 and 6, a bracket 106 is fixedly attached to the side plate 38 forming the interior support frame of the sheet feeder 10 through a support bar 108 and is held stationary thereby. A horizontally projecting flanged portion 110 of the bracket 106 has an aperture 112 therein sized to slidably receive a rod 114. The rod 114 is fixedly attached to the midportion of a laterally extending member 116. The member 116 has a downwardly extending arm 118 fixedly attached to each of its lateral ends. Each of the spaced-apart arms 118 has a downwardly opening, elongated slot 120 sized to receive therein a correspondingly notched portion 122 of the shaft 100. The slots 120 and notches 122 help prevent the shaft 100 from rotating. The downward biasing force on the shaft 100 is applied through the arms 118 by a spring 124 positioned around the rod 124 and between the flanged bracket portion 110 and the member 116.

The upper feed rollers 94 are positioned substantially equidistant from the longitudinal center line of the upper feed path, and the arms 118 are positioned symmetrically with respect to the upper feed rollers to provide a substantially equal downward force on the shaft 100 at two spaced-apart positions, and hence an even force on both of the upper feed rollers. The aperture 112 in the flanged bracket portion 110 which receives the rod 114 is sized sufficiently large to permit free angular movement of the rod therein as the upper feed rollers 94 move during operation in response to sheets passing between them and the lower feed rollers 96 as the upper feed rollers seek to apply an even pressure against the sheet.

In the presently preferred embodiment of the invention, the lower feed rollers 96 and the shaft 98 are integrally formed from turned aluminum stock, and the upper feed rollers 94 have a urethane coating to improve sheet contact. Also integrally formed as a part of the shaft 98 is a lower detector roller 126, situated between the lower feed rollers 96. As best shown in FIG. 12, the lower detector roller 126 projects upwardly through an opening in the lower guide plate 86 and is opposed by an upper detector roller 128 which projects downwardly through an opening in the upper guide plate 84, for passage of the sheet therebetween. The upper detector roller 128 is positioned generally coaxial with the upper feed rollers 94 and between the downwardly extending arms 118, which apply the downward biasing force to the shaft 100 on which the upper feed rollers are carried. The upper detector roller 128 has an enlarged axial opening 130 through which the shaft 100 extends. It is noted that the upper detector roller 128 is not mounted on the shaft 100 and the axial opening 130 allows the shaft 100 to move freely during operation of the sheet feeder 10 without contacting the upper detector roller.

The upper detector roller 128 is rotatably supported by one end portion of a generally horizontally extending link 132 at a preselected distance above the lower detector roller 126 to provide a desired spacing between the sheet engaging surfaces of the upper and lower detector rollers. The spacing is adjustably set to be slightly larger than the thickness of a single sheet being fed by the sheet feeder 10, but less than the thickness of two sheets. As best shown in the exploded portion of FIG. 6, the upper detector roller 128 is an idler roller mounted on an open ended cylinder **128*a* which is fixedly attached to the link 132 and extends laterally therefrom. A bearing 128*b* is positioned between a sheet engagement wheel 128*c* and the cylinder 128*a*** to permit the free rotation of the wheel in response to contact with sheets moving thereunder.

The link 132 extends forwardly along the upper feed path and is fixedly attached to a shaft 134 positioned forward of the shaft 100 carrying the upper feed rollers 94. The shaft 134 is rotatable responsive to movement of the link 132 as a result of passage of more than one sheet at the same time between the lower and upper detector rollers 126 and 128. As previously noted, the axial opening 130 in the upper detector roller 128 is of sufficient size to avoid any contact with the shaft 100, even when the upper detector roller moves the link in response to more than one sheet of paper moving between the detector rollers 126 and 128.

Vertical movement of the upper detector roller 128 away from the lower detector roller 126 as a result of more than one sheet passing therebetween is translated into rotational movement of the shaft 134, which causes movement of an elongated arm 136 fixedly attached by one end portion **136*a* to an end portion of the shaft 134 extending beyond the side frame plate 38. The elongated arm 136 is positioned outward of the right side frame plate 38, and extends substantially straight down from the shaft 134. The end portion 136*a* of the arm 136 is clamped on the shaft 134 using a screw 137. The elongated arm 136 has a vane 138 at its opposite end portion 136*b* which is positioned for interrupting a beam of light projecting between a light source 140 and a photodetector 142 (see FIGS. 12 and 13**).

The vane 138 is positioned such that passage of more than one sheet between the lower and upper detector rollers 126 and 128 produces rotation of the shaft 134 sufficient to move the vane into the beam of light and thereby generate a doubles detection indicator signal. The signal indicates more than one sheet is passing through the doubled detector rollers 126 and 128, and hence the adjacent feed rollers 94, and is the signal sent the apparatus 22 to which the sheet feeder 10 is connected.

The sheet feeder 10 is provided with an adjusting mechanism for adjustably setting the position of the upper detector roller 128 above the lower detector roller 126 according to the thickness of the sheets being fed. The adjusting mechanism further provides for adjusting the position of the vane 138 relative to the beam of light to establish a threshold position. As shown in FIG. 12, the first adjustment is accomplished by turning of a hand-operated knob 144 rotatable between rotational positions corresponding to the standard thickness of the sheets typically fed by the sheet feeder. As shown in FIG. 14, the knob 144 is calibrated for 16, 20 and 24 pound paper sheets; however, the adjustment is continuous and can be used to set the doubles detector rollers 126 and 128 for any weight sheet being used, with the knob being calibrated with as many weight or thickness settings as desired. A stop 146 is fixedly attached to the knob 144 for limiting rotation of the knob to one full revolution corresponding to the extreme sheet weight settings for the knob.

The knob 144 has an interiorly threaded portion 148 and an exteriorly threaded portion 150 with the same hand thread and a slightly larger lead angle. The exteriorly threaded portion 150 is threadably received by a correspondingly threaded stationary member 152 fixedly attached to an outer wall surface of the right side frame plate 38 by a bracket 154. A threaded shaft 156 is threadably received by the interiorly threaded portion 148 of the knob 144 and has threads corresponding thereto. The end portion of the threaded shaft 156 distal from the end portion received by the interior threads 148 of the knob 144 is threadably received by a threaded member 158 which is fixedly attached to a movable, resilient arm 162 of the bracket 154. The threaded shaft 156 has a head 160 affixed thereto and positioned to a side of the resilient arm 162 away from the knob 144 and in contact therewith to prevent rotation of the shaft 156 as the knob is turned for adjusting the position of the upper detector roller 128. Turning the knob 144 produces axial movement of the shaft 156 and hence movement of the resilient arm 162 in the same direction.

Fixedly attached to the resilient arm 162 for travel therewith as the knob 144 is turned, is a support 164 on which is mounted the spaced-apart light source 140 and photodetector 142. The source and detector sensor pair 140/142 has, fixedly attached thereto and positioned away from the support 164, a U-shaped block 166. The block 166 and the source detector sensor pair 140/142 define therebetween an opening 168 through which the vane 138 of the elongated arm 136 is movable in a path transverse to the light beam.

To provide an adjustment for positioning of the vane 138 relative to the light beam, which determines how far the vane must move to break the light beam should more than one sheet pass between the detector rollers 126 and 128 (i.e., a threshold position), and thereby sets the sensitivity of the source and detector sensor pair 140/142 the block has an aperture 170 threaded to receive an adjustment screw 172 with a flat head 174. The head 174 is sized and positioned to engage a finger portion 176 of the elongated arm 136 spaced apart from the vane 138. As a result of the cantilevered arrangement of upper detector roller 128 relative to the elongated arm 136, the weight of the roller tends to bias the finger portion 176 of the arm toward the head 174 of the adjustment screw 172. A further bias force is supplied by a spring 178 which is attached between the elongated arm 136 and the side frame plate 38.

By turning the adjustment screw 172, the finger portion 176 is moved to set the vane 138 at the desired distance from the light beam. During normal operation further adjustment of the threshold position is not necessary unless it is desired to increase the sensitivity of the doubles detector. Once the threshold position is set, the source and detector sensor pair 140/142, the block 166, the adjustment screw 172, and the elongated arm 136 move as a unit when the knob 144 is turned to adjust the position of the upper detector wheel 128.

With the interiorly and exteriorly threaded portions 148 and 150 of the knob 144 having the same hand thread and slightly different lead angles, rotation of the knob produce differential movement between the shaft 156 and the knob with respect to the stationary bracket 154. The use of differential movement provides a fine and quick adjustment without the need to insert sample sheets between the detector rollers 126 and 128 to set their spacing. By merely turning the knob 144, the shaft 156 is moved axially and the resilient arm 162 and the block 166 moved in response thereto. The movement is transmitted to the finger portion 176 of the elongated arm 136 to raise or lower the upper detector roller 128 relative to the lower detector roller 126. The knob 144 is calibrated for the thickness of the sheets, and when turned to the proper setting for the sheet thickness being used, causes the vane 138 to interrupt the light beam and generate the doubles detector indicator signal only when more than one sheet passes between the detector rollers 126 and 128.

To this point, the feeding machanism described for the upper tray 14 is generally the same as for the lower tray 16, with the feeding mechanisms for both trays conveying sheets in the same direction of travel. Because of the elevational difference of the upper and lower trays 14 and 16, and the requirement that sheets be fed to the apparatus 22 with which the sheet feeder 10 is operating along a single output feed path, it is necessary to bring the two upper and lower feed paths together. In the presently preferred embodiment of the invention, sheets fed from the lower tray 16 travel along a straight through feed path from the lower stack 171 between the upper and lower guide plates 84 and 86 for the lower path, and then a short distance directly into the receiving rollers of the apparatus 22 to which the sheet feeder 10 is connected.

The sheets fed from the upper tray 14 exit from between the upper and lower guide plates 84 and 86 for the upper feed path and then enter into an input 180 of a curved deflector 182. An output 184 of the deflector 182 deposits the sheets along the feed path for the sheets from the lower tray 16, to provide a single output feed path supplied by two trays. The deflector 182 has a smooth, "S" shaped deflector path extending between its input and output 180 and 184 to guide sheets from the level of the guide plates 84 and 86 of the upper feed path to the level of the guide plates for lower feed path, such that sheets from both the upper and lower feeding mechanisms travel along their respective feed paths and into the output feed path in the same direction.

The deflector 182 has a curved upper portion 186 for guiding the sheets from the upper feed path through slightly greater than a ninety degree downwardly directed turn, and a curved lower portion 188 for guiding the sheets received from the curved upper portion through a slightly greater than ninety degree rearwardly directed turn. The deflector 182 provides a continuous, gradually turning deflector path with a large radii. The curvature of the path is made as large as possible within the space constraints of the sheet feeder 10, to minimize the resistance the deflector 182 applies to a sheet which could cause skewing, particularly since the sheet is primarily being pushed through the deflector by the feed rollers 94 nd 96, rather than being pulled through.

In the presently preferred embodiment of the invention, the deflector 182 is comprised of a plurality of spaced-apart, substantially parallel deflector plate assemblies 190 oriented generally transverse to the conveyed sheets. Each of the deflector plate assemblies includes a pair of plates **190*a* and 190*b* with edge portions spaced apart and shaped to form the deflector path for passage of sheets therebetween. The deflector plates 190*a* and 190*b* are oriented substantially vertically and held in fixed position between the side frame plates 38 by a plurality of retainer bars 192**.

In order to provide a minimal interval or spacing between successive sheets delivered to the apparatus 22 to which the sheet feeder 10 is connected and to increase the operating speed of the sheet feeder, when one sheet is conveyed from the lower tray 16 and the next from the upper tray 14, the sheet from the upper tray is held in a ready position immediately adjacent to the output feed path for rapid delivery thereto upon demand. Without the ready position, sheets fed from the upper sheet rack 17*u* on the upper tray 14 would travel along the entire length of the upper feed path and take too long to reach the apparatus 22 after a sheet request signal was given. This not only slows down the sheet feeding rate of the sheet feeder 10, but also can cause the apparatus 22 to register a misfeed condition if the sheet is not received within the preset time the apparatus allows for the sheet to be received after the sheet request signal is given. While the lower feed path is shorter and has a straight through feed, the supply of sheets from the lower tray 16 to the apparatus 22 can also be increased by use of a ready position for the lower feed path. Since the operation of the sensors necessary to control placement and holding of a sheet in the ready position is generally the same for both the upper and lower trays 14 and 16, only the sensor placement and operation for the upper tray will be described.

Figure 15:
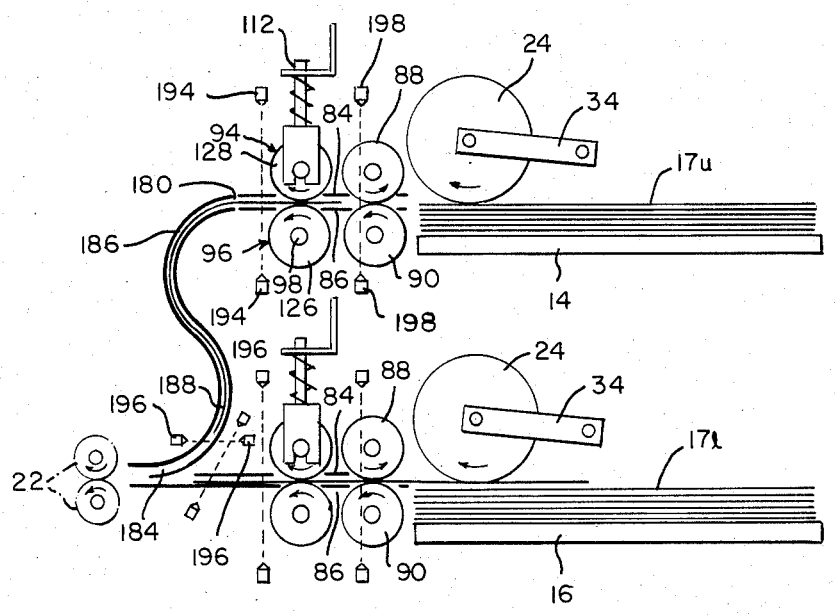
FIG. 15 is a schematic side elevational view of the sheet feeder of FIG. 1, showing the placement of the sensors which control the operation of the sheet feeding mechanisms of the upper and lower trays.

The placement of the sensors used to control the feeding mechanism are shown in FIG. 4, and the operation of the sensor is best described with reference to FIG. 15. FIG. 15 is a schematic representation of the upper and lower sheet stacks 17*u* and 17*l* in engagement with their respective engagement wheels 24 and with sheets in the ready positions for the upper and lower feed paths.

The upper feed path has a first optical interruption sensor 194 positioned along the upper feed path forward of the feed rollers 94 and 96 (and the detector rollers 126 and 128) for detecting the receipt of a sheet from the upper stack 17*u* under the forward drive of the engagement wheel 24. This position of the feed rollers 94 and 96 is substantially coincidental with the detector rollers 126 and 128 in FIG. 15, so an arrow has been used to indicate the feed rollers. Upon passage of the leading edge of the sheet beyond the feed rollers 94 and 96, the sheet is provided forward drive by the feed rollers 94 and 96, and the sensor 194 generates a signal to the clutch 30 to disengage the engagement wheel 24. The engagement wheel 24 then ceases to provide forward drive to the sheet being conveyed until the next sheet is required from the upper stack 17*u*. By the time the feed rollers 94 and 96 pull the sheet from between the engagement wheel 24 and the remainder of the stack of sheets 17*u*, the engagement wheel will have stopped operating and thus will not convey the next upper sheet forward. This avoids the engagement wheel 24 double feeding sheets to the feed rollers 94 and 96 and placing two sheets in the ready position. The feed rollers 94 and 96 are positioned along the upper feed path a distance form the engagement roller 24 no greater than the length of the shortest sheet being conveyed by the sheet feeder 10 in order that the sheet is always able to be forwardly driven by either the engagement wheel or the feed rollers to provide a controlled forward drive to the sheet.

A second optical interruption sensor 196 is provided along the curved lower portion 188 of the deflector 182 for detecting passage of the sheet into the ready position by sensing passage of the leading edge of the sheet into a position just prior to merging with the lower feed path to form a single output feed path to the apparatus 22 with which the sheet feeder is connected. Upon sensing of the sheet in the ready position, the second sensor 196 generates a signal to the clutch 32 to disengage the upper drive chain 33 and thus the feed rollers 94 and 96. The sheet is held in the ready position where it is ready for rapid delivery by the feed rollers 94 and 96 to the output feed path upon demand.

Upon receipt of a request signal from the apparatus 22 with which the sheet feeder 10 is connected for a sheet from the upper tray 14, the clutch 32 is engaged and the feed rollers 94 and 96 are again driven to convey the sheet from the ready position. The second sensor 196 is positioned forward of the feed rollers 94 and 96 along the upper feed path a distance such that the shortest sheet being conveyed by the sheet feeder 10 when held in the ready position will extend backward past the feed rollers by a sufficient amount that the feed rollers will be able to provide forward drive to the sheet until it reaches the receiving rollers for the apparatus 22. Since the forward drive being provided to the sheet as it travels into and out of the ready position is a pushing force by the feed rollers 94 and 96 largely on the trailing portions of the sheet, it is important that an even and straight forward drive is provided. The second sensor 196 is angularly oriented and positioned such that the light beam for the sensor passes through the upper feed path but not the lower feed path.

The sheet feeder 10 further has a third optical interruption sensor 198 positioned along the upper feed path between the feed rollers 94 and 96 and the separator rollers 88 and 90 for detecting passage of the sheet out of the ready position in response to receipt of a sheet request signal from the apparatus 22, and generating a signal to the clutch 30 to engage the engagement wheel 24 and convey the next upper sheet from the stack 17*u*. The third sensor 198 senses passage of the trailing edge of the sheet which is held in the ready position as the feed rollers 94 and 96 convey the sheet to the apparatus 22, and allows the next upper sheet to be fed from the upper stack 17*u* with a minimal interval between the two sheets.

The sequence just described involving the first, second and third sensors 194, 196 and 198 is repeated for the next upper sheet and a continuous flow of sheets is provided upon demand from the upper tray 14 with little delay. As previously noted, use of the ready position located adjacent to the lower feed path and the output feed path allows the almost immediate insertion of sheets from the upper tray 14 into the flow of sheets from the lower tray 16 with minimal intervals between the sheets from the two paths to provide an improved edge-to-edge flow of sheets alternately fed from the two trays. In the past, alternate feeding from two trays usually produced a gap of about two to three inches between the sheets. With the use of the ready position of the present invention, a sheet may be fed from the ready position for the upper tray 14 in approximately 30 milliseconds after receipt of a sheet request signal from the apparatus 22 to which the sheet feeder 103 is connected. Without the ready position the time for feeding a sheet directly from the upper tray 14 would be approximately 200 to 250 milliseonds. This is to be compared with the time for feeding a sheet directly from the lower tray of 60 to 70 milliseconds.

As previously noted, the lower tray 16 utilizes the same three-sensor arrangement and places a sheet in a ready position close to the output of the lower feed path to reduce the time required to obtain sheets from the lower tray upon receipt of a signal requesting a sheet from the lower tray.

As best shown in FIG. 4 for the lower tray 16, each tray of the sheet feeder 10 is provided with two microswitches which are activated as the tray is raised or lowered. A first microswitch 200 senses that the tray 16 has reached its lower position for loading of sheets, and a second microswitch 202 senses that the tray is in a position to indicate a low supply of sheets on the tray. The first and second microswitches 200 and 202 are activated by an engagement member 204 which is attached to and travels with the lower tray.

Each tray of the sheet feeder 10 also has a last sheet sensor 206 comprising a light source and photodetector pair positioned to opposite sides of the tray and an aperture 208 through the tray in alignment with the sensor. The sensor 206 indicates when the last sheet has been removed from the tray. It is noted that when the sheet feeder 10 has fed all sheets from a tray, and after the sheet being held in the ready position is conveyed away, the third sensor 198 activates the engagement wheel 24. This causes the engagement wheel 24 to automatically feed the upper sheet of a new stack placed on the tray when the tray is raised into position for feeding.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A feed wheel assembly mountable to a support frame for conveying the upper sheet from a stack of sheets, comprising:

an engagement wheel positionable above the stack for contact with the upper sheet of the stack and operable to separate and convey the upper sheet from the stack;

a generally horizontally extending rotatable first shaft on which said wheel is mounted for rotation therewith;

drive means connected to said first shaft for selective rotation of said wheel while permitting substantially unrestricted vertical and angular movement of said first shaft during operation within at least a limited range;

a generally horizontally extending second shaft positioned spaced apart from and generally parallel with said first shaft, said second shaft being mountable in a substantially fixed position relative to the support frame and being at least partially rotatable, whereby rotation of said second shaft is detectable to drive a stack raising mechanism as sheets are removed;

a pair of laterally spaced-apart first and second arms extending between said first and second shafts with said wheel positioned therebetween, each of said first and second arms having a first portion rotatably supporting said first shaft axially outward of said wheel opposite said first portion of the other of said arms, and having a second portion longitudinally spaced from said first portion and pivotally connected to said second shaft, said first and second arms being pivotally movable independent of each other about said second shaft within at least a limited range under the weight of said wheel;

a third shaft positioned intermediate of said wheel and said second shaft and extending between said first and second arms at a midportion thereof positioned between said first and second portions, said third shaft being loosely received within a retaining aperture in each of said first and second arms; and a pin extending between said second shaft and said third shaft, said pin being fixedly attached to said second shaft for rotation therewith and being pivotally attached to said third shaft, whereby said wheel can move substantially unimpeded to seek contact with the upper sheet of the stack along the full axial length thereof, while being free to move downward as upper sheets of the stack are successively conveyed away and to move upward as the stack is raised during periodic repositioning thereof to compensate for decreasing stack height, and whereby rotation of said second shaft responsive to said wheel moving downward to contact the upper sheets of the stack as the stack height decreases can be sensed to actuate a mechanism to periodically raise the stack.

2. The feed wheel assembly of claim 1 wherein said drive means includes a universal coupler drivingly connecting said first shaft to a rotatable drive shaft while permitting substantially unrestricted vertical movement of said first shaft relative to said drive shaft during operation.

3. The feed wheel assembly of claim 1 wherein said pin extends between said second shaft and said third shaft generally along the longitudinal center line between said first and second arms, with elevational movement of said wheel being transmitted through said pin to said second shaft substantially without effect on the angular axial orientation of said wheel.

4. The feed wheel assembly of claim 3 wherein said drive means is connected to said first shaft outward of said first arm, and the feed wheel assembly further includes an adjustable balance weight connected to apply a counterbalance force to said second arm to maintain balance of the assembly generally along the longitudinal center line during operation.

5. The feed wheel assembly of claim 1 wherein said first and second shafts are positioned generally coplanar in a horizontal plane.

6. The feed wheel assembly of claim 1 wherein said second portions of said first and second arms each have an aperture therein loosely receiving said second shaft.

7. The feed wheel assembly of claim 1 wherein an end portion of said pin is loosely received within a radial bore in said third shaft.

8. The feed wheel assembly of claim 1 wherein said first and second arms each have an inwardly projecting portion fixedly attached to said second portion and positioned to a side of said second shaft away from said wheel, said inwardly projecting portions slidably engaging said second shaft to limit outward lateral movement of said arms.

9. A feed wheel assembly for conveying an end sheet from a stack of sheets, comprising:

a rotatable engagement wheel positionable to contact the end sheet of the stack and operable to separate and convey the end sheet from the stack;

a generally horizontally extending first shaft on which said wheel is mounted, said first shaft being angularly movable in a generally vertical direction;

a generally horizontally extending second shaft positioned spaced apart from said first shaft, said second shaft being mountable in a substantially fixed planar orientation;

a pair of laterally spaced-apart first and second arms extending between said first and second shafts, each of said first and second arms having a first portion retaining said first shaft and a second portion longitudinally spaced from said first portion and pivotally connected to said second shaft, said first and second arms being pivotally movable about said second shaft within at least a limited range to permit uninhibited angular movement of said first shaft in a generally vertical direction during operation;

a connector positioned intermediate of said wheel and said second shaft and extending between said first and second arms, said connector being pivotally attached to each of said first and second arms; and a link extending between said second shaft and said connector, said link being attached to said second shaft and said connector to rotate said second shaft in response to vertical movement of said first shaft and being axially rotatable relative to at least one of said second shaft or said connector to permit angular movement of said first shaft.

10. The feed wheel assembly of claim 9 wherein said first portion of said first and second arms rotatably supports said first shaft, and said first and second arms are pivotally movable about said second shaft independent of each other within at least a limited range to permit angular movement of said first shaft during operation.

11. The feed wheel assembly of claim 9, further including joint means connected to said first shaft for transmission of rotary drive to said wheel while permitting substantially unrestricted vertical and angular movement of said first shaft during operation within at least a limited range.

12. A sheet feeder, comprising:

a receiving tray for holding a stack of sheets;

an incrementally driven engagement wheel positioned above said receiving tray for contact with the upper sheet of the stack and operable to separate ad convey the upper sheet from the stack by rotation of said wheel;

a generally horizontally extending first shaft on which said engagement wheel is mounted;

a generally horizontally extending second shaft positioned spaced apart from said first shaft, said second shaft being mountable in a substantially fixed position;

a pair of laterally spaced-apart first and second arms extending between said first and second shafts, each of said first and second arms having a first portion retaining said first shaft and a second portion longitudinally spaced from said first portion and pivotally connected to said second shaft, said first and second arms being pivotally movable about said second shaft within at least a limited range to permit free angular movement of said first shaft in a generally vertical direction during operation;

feed means for receiving the upper sheet conveyed by said engagement wheel and feeding the upper sheet along a feed path to the apparatus to which the sheet feeder is connected;

a connector positioned intermediate of said engagement wheel and said second shaft and extending between said first and second arms, said connector being pivotally attached to each of said first and second arms; and a link extending between said second shaft and said connector, said link being attached to said second shaft and said connector to rotate said second shaft in response to vertical movement of said first shaft and being axially rotatable relative to at least one of said second shaft or said connector to permit angular movement of said first shaft.

13. The sheet feeder of claim 12, further including means for raising said receiving tray responsive to rotation of said second shaft resulting from downward movement of said wheel as upper sheets of the stack are successively conveyed away, whereby the stack can be raised to compensate for decreasing stack height.

14. The sheet feeder of claim 12, further including first sensor means for detecting receipt of the upper sheet by said feed means and deactivating said engagement wheel and second sensor means for detecting passage of the upper sheet into a ready position and deactivating said feed means, said ready position being located for rapid delivery of the upper sheet therefrom by said feed means, and means responsive to a sheet request signal from the apparatus to which the sheet feeder is connected for activating said feed means to convey the upper sheet to the apparatus.

15. The sheet feeder of claim 14, further including a third sensor means for detecting passage of the upper sheet from said ready position and actuating said engagement wheel to convey the next upper sheet from the stack.

16. The sheet feeder of claim 12, further including:

a second receiving tray for holding a second stack of sheets, positioned above said first receiving tray;

an incrementally driven second engagement wheel positioned above said second receiving tray for contact with the upper sheet of the second stack and operable to separate and convey the upper sheet from the second stack by rotation of said second wheel;

a generally horizontal extending third shaft on which said second engagement wheel is mounted;

a generally horizontally extending fourth shaft positioned spaced apart from said third shaft, said fourth shaft being mountable in a substantially fixed position;

a pair of laterally spaced-apart third and fourth arms extending between said third and fourth shafts, each of said third and fourth arms having a first portion retaining said third shaft and a second portion longitudinally spaced from said first portion and pivotally connected to said fourth shaft, said third and fourth arms being pivotally movable about said fourth shaft within at least a limited range to permit free angular movement of said third shaft in a generally vertical direction during operation; and second feed means for receiving the upper sheet conveyed by said second engagement wheel and feeding the upper sheet to a curved deflector with an input for receiving the upper sheet of the second stack from said second feed means and an output for depositing the upper sheet of the second stack along said feed path for feeding to the apparatus to which the sheet feeder is connected, whereby the apparatus is fed sheets from a single feed path supplied by two trays.

17. The sheet feeder of claim 16 wherein said first and second feed means feed sheets in the same direction of travel, and said deflector has a reverse-curve, arcuate-shaped deflector path to guide sheets from the level of the second feed means to the level of the lower feed means for travel of sheets from both feed means along said feed path in the same direction.

18. The sheet feeder of claim 17 wherein said deflector has an upper curved section for guiding the sheets from the second feed means through at least a 90° downwardly directed turn, and a lower curved section for guiding the sheets received from the upper curved section through at least a 90° outwardly directed turn, whereby a continuous, gradually turning deflector path is achieved with large radii.

19. The sheet feeder of claim 18 wherein said upper and lower curved sections are connected together by an intermediate section, and said upper curved section has an enlarged deflector path.

20. The sheet feeder of claim 16 wherein said deflector is comprised of a plurality of substantially parallel deflector plate assemblies oriented generally transverse to the conveyed sheets, each of said deflector plate assemblies including a pair of plates with spaced-apart edge portions shaped to form said deflector path for passage of sheets therebetween.

21. The sheet feeder of claim 12, further including separating means for receiving the upper sheet conveyed by said engagement wheel and ensuring isolation of a single sheet, said separating means including a pair of opposed, spaced-apart upper and lower rollers between which the upper sheet of the stack is received from said engagement wheel, said upper and lower rollers rotating in the same rotational direction to urge the upper sheet toward said feed means and any other sheets travelling therewith back toward said engagement wheel.

22. The sheet feeder of claim 12 wherein said feed means includes two pairs of opposed upper and lower rollers between which the upper sheet of the stack is received from said engagement wheel, one roller of each pair being biased toward the other and at least said upper or lower roller of each pair being rotatably driven, said two pairs of rollers being axially spaced apart.

23. The sheet feeder of claim 22 wherein said upper rollers are rotatably mounted on a roller shaft, said roller shaft being substantially unrestrained against angular movement in a generally vertical direction, and said feed means includes biasing means for application of a balanced downward biasing force on said upper rollers, said biasing means applying a substantially equal downward force to said roller shaft at two spaced-apart positions substantially symmetrical with respect to said upper rollers.

24. The sheet feeder of claim 12 wherein said feed means includes a pair of axially spaced-apart upper rollers mounted on an upper roller shaft which is substantially unrestrained against angular movement in a generally vertical plane, a pair of axially spaced-apart, rotatably driven lower rollers mounted on a lower driven shaft, each of said lower rollers being positioned opposite one of said upper rollers for receiving the upper sheet of the stack therebetween from said engagement wheel, and biasing means for the application of a balanced, downward biasing force on said upper rollers.

25. The sheet feeder of claim 24, further including means for permitting said upper rollers to freely rotate in a rotational direction corresponding to the direction of travel of sheets conveyed by said driven lower rollers, but restraining said upper rollers against rotation in the opposite rotational direction.

26. The sheet feeder of claim 24 wherein said biasing means includes a member positioned above said upper roller shaft and having a pair of downwardly extending arms engaging said upper roller shaft for application of said downward biasing force thereto and being axially spaced apart along said upper roller shaft, said member being vertically and pivotally movable in a generally vertical plane, said member being biased toward said upper roller shaft by a resilient biasing element.

27. The sheet feeder of claim 12 wherein said feed means includes at least one pair of opposed upper and lower feed rollers biased toward each other and between which the upper sheet of the stack is received from said engagement wheel, said upper feed roller being mounted on an upper shaft and said lower feed roller being mounted on a lower shaft, and the sheet feeder further including means for detecting more than one sheet being conveyed by said engagement wheel between said upper and lower feed rollers, said detecting means including an upper detector roller positioned generally coaxial with said upper feed roller and having an enlarged axial opening for uninhibited passage of said upper shaft therethrough, a lower detector roller mounted on said lower shaft, a link rotatably supporting said upper detector roller in a position a preselected distance above said lower detector roller and connecting said upper detector roller to a detector shaft for translating vertical movement of said upper detector roller responsive to passage of more than one sheet between said upper and lower detector rollers into rotational movement of said detector shaft, an elongated arm fixedly attached by one end portion to said detector shaft and having a vane at its opposite end portion for interrupting a beam of light projecting between a light source and a photodetector, passage of more than one sheet between said upper and lower detector rollers producing rotation of said detector shaft to move said vane into or out of said beam of light and thereby generating an indicator signal, and said detector means further including first adjustment means for adjusting said position of said upper detector roller above said lower detector roller to adjust said distance therebetween according to the thickness of the sheets being feed.

28. The sheet feeder of claim 27 wherein said detector means further includes second adjustment means for adjusting the position of said vane relative to said beam of light to a desired distance therefrom for establishing a threshold sensing position.

29. The sheet feeder of claim 27 wherein said first adjustment means includes a hand operated knob rotatable between at least two rotational positions, each corresponding to a thickness of the sheets being fed, and actuation means responsive to rotation of said knob between said at least two rotational positions to adjustably fix said distance of said upper detector roller above said lower detector roller to cause said indicator signal to be generated only when more than one sheet of the thickness sheet being fed passes between said upper and lower detector rollers.

30. A sheet feeder, comprising:

a receiving tray for holding a stack of sheets;

an incrementally driven engagement wheel positioned above said receiving tray for contact with the upper sheet of the stack and operable to separate and convey the upper sheet from the stack by rotation of said wheel;

a generally horizontal extending first shaft on which said engagement wheel is mounted;

a generally horizontally extending second shaft positioned spaced apart from said first shaft, said second shaft being mountable in a substantially fixed position;

a pair of laterally spaced-apart first and second arms extending between said first and second shafts, each of said first and second arms having a first portion retaining said first shaft and a second portion longitudinally spaced from said first portion and pivotally connected to said second shaft, said first and second arms being pivotally movable about said second shaft within at least a limited range to permit free angular movement of said first shaft in a generally vertical direction during operation;

feed means for receiving the upper sheet conveyed by said engagement wheel and feeding the upper sheet along a feed path to the apparatus to which the sheet feeder is connected, said feed means includes at least one pair of opposed upper and lower feed rollers biased toward each other and between which the upper sheet of the stack is received from said engagement wheel, said upper feed roller being mounted on an upper shaft and said lower feed roller being mounted on a lower shaft, and the sheet feeder further including means for detecting more than one sheet being conveyed by said engagement wheel between said upper and lower feed rollers, said detecting means including an upper detector roller positioned generally coaxial with said upper feed roller and having an enlarged axial opening for uninhibited passage of said upper shaft therethrough, a lower detector roller mounted on said lower shaft, a link rotatably supporting said upper detector roller in a position a preselected distance above said lower detector roller and connecting said upper detector roller to a detector shaft for translating vertical movement of said upper detector roller responsive to passage of more than one sheet between said upper and lower detector rollers into rotational movement of said detector shaft, an enlongated arm fixedly attached by one end portion to said detector shaft and having a vane as its opposite end portion for interrupting a beam of light projecting between a light source and a photodetector, passage of more than one sheet between said upper and lower detector rollers producing rotation of said detector shaft to move said vane into or out of said beam of light and thereby generating an indicator signal, and said detector means further including first adjustment means for adjusting said position of said upper detector roller above said lower detector roller to adjust said distance therebetween according to the thickness of the sheets being feed, said first adjustment means including a hand operated knob rotatable between at least two rotational positions, each corresponding to a thickness of the sheets being fed, and actuation means responsive to rotation of said knob between said at least two rotational positions to adjustably fix said distance of said upper detector roller above said lower detector roller to cause said indicator signal to be generated only when more than one sheet of the thickness sheet being fed passes between said upper and lower detector rollers, said knob having an interiorly threaded portion and an exteriorly threaded portion, said exteriorly threaded portion being threadably received by a correspondingly threaded fixed member, and said actuation means includes a threaded shaft threadably received by said interiorly threaded portion of said knob and having threads corresponding thereto, said interiorly and exteriorly threaded portions of said knob having the same hand threads with different lead angles to produce differential movement between said shaft and said knob and to move said shaft axially upon rotation of said knob, said shaft engaging said elongated arm for movement thereof, whereby movement of said arm is transmitted through said link to adjust the position of said upper detector roller above said lower detector roller.

31. The sheet feeder of claim 30 wherein said actuation means further includes a resilient member biasing said threaded shaft axially toward said knob.

32. The sheet feeder of claim 31 wherein said light source and photodetector are connected to said shaft in fixed relative relation for movement therewith, and said detector means further includes a second threaded shaft engaging said elongated arm for adjusting the position of said vane relative to said beam of light projecting between said light source and photodetector by rotation of said second threaded shaft.

* * * * *